US008807032B2

(12) United States Patent
Shin et al.

(10) Patent No.: US 8,807,032 B2
(45) Date of Patent: Aug. 19, 2014

(54) FEEDFORWARD CONTROL OF DOWNSTREAM REGISTER ERRORS FOR ELECTRONIC ROLL-TO-ROLL PRINTING SYSTEM

(75) Inventors: Kee-Hyun Shin, Seongnam-si (KR); Hyun-Kyoo Kang, Seoul (KR)

(73) Assignee: Konkuk University Industrial Cooperation Corp., Seoul (KR)

( * ) Notice: Subject to any disclaimer, the term of this patent is extended or adjusted under 35 U.S.C. 154(b) by 0 days.

(21) Appl. No.: 12/859,719

(22) Filed: Aug. 19, 2010

(65) Prior Publication Data

US 2011/0203472 A1 Aug. 25, 2011

Related U.S. Application Data

(63) Continuation of application No. PCT/KR2008/003761, filed on Jun. 28, 2008.

(30) Foreign Application Priority Data

Feb. 19, 2008 (KR) ..... 10-2008-0014933

(51) Int. Cl.
*B41F 13/00* (2006.01)
*B41F 13/02* (2006.01)

(52) U.S. Cl.
CPC ..... *B41F 13/025* (2013.01)
USPC ..... 101/484; 101/485

(58) Field of Classification Search
USPC ..... 101/248, 286, 481, 485, 486
See application file for complete search history.

(56) References Cited

U.S. PATENT DOCUMENTS

| | | | | |
|---|---|---|---|---|
| 5,615,609 | A * | 4/1997 | Hill et al. | 101/183 |
| 5,735,205 | A * | 4/1998 | Nordgren | 101/181 |
| 6,092,466 | A * | 7/2000 | Koch et al. | 101/485 |
| 6,523,468 | B1 * | 2/2003 | Loffler et al. | 101/211 |
| 6,532,872 | B2 * | 3/2003 | Siegl et al. | 101/483 |
| 6,615,732 | B2 * | 9/2003 | Hunold et al. | 101/486 |
| 6,827,018 | B1 * | 12/2004 | Hartmann et al. | 101/485 |
| 2001/0022143 | A1 * | 9/2001 | Stern | 101/248 |
| 2002/0117068 | A1 * | 8/2002 | Cote et al. | 101/484 |
| 2003/0136283 | A1 * | 7/2003 | Tokiwa | 101/226 |
| 2004/0134364 | A1 * | 7/2004 | Schultze et al. | 101/248 |
| 2005/0034578 | A1 * | 2/2005 | Brandenburg et al. | 83/13 |
| 2007/0017398 | A1 * | 1/2007 | Doeres et al. | 101/484 |
| 2009/0211473 | A1 * | 8/2009 | Peters et al. | 101/170 |
| 2009/0293746 | A1 * | 12/2009 | Schultze et al. | 101/248 |

* cited by examiner

*Primary Examiner* — Matthew G Marini
*Assistant Examiner* — David Banh
(74) *Attorney, Agent, or Firm* — Antonio Ha & U.S. Patent, LLC

(57) ABSTRACT

An ultra-precision register control method in a continuous roll-to-roll printing process for manufacturing electronic devices via a feedforward register control logic, which compensates for and eliminates additional register errors attributable to variations in the speed of upstream printing cylinders. When used in combination with a conventional feedback register control logic, the feedforward register control logic accomplishes a register control with ultra-precision in a continuous roll-to-roll printing process, and enables implementation of a continuous roll-to-roll printing process for manufacturing electronic devices, for which a roll-to-roll printing process was formerly unavailable.

7 Claims, 4 Drawing Sheets

FEEDFORWARD CONTROL OF DOWNSTREAM REGISTER ERRORS FOR ELECTRONIC ROLL-TO-ROLL PRINTING SYSTEM

CROSS-REFERENCE TO RELATED APPLICATIONS

This application claims priority to and is a continuation of a co-pending International Application No. PCT/KR2008/003761 filed on Jun. 28, 2008, which claimed priority to a patent application No. KR 10-2008-0014933, filed on Feb. 19, 2008 in Korea and issued as a patent with No. 10-0953475 on Apr. 9, 2010, and hereby claims the benefit thereof.

BACKGROUND OF THE INVENTION

The present invention relates to the field of a continuous roll-to-roll printing method for manufacturing electronic devices. More particularly, the present invention relates to an ultra-precision register control method in a continuous roll-to-roll printing process for manufacturing electronic devices, by which additional register errors attributable to variations in the speed of upstream printing cylinders are compensated for and eliminated for enhanced accuracy by using a feedforward control logic.

Recently, attention has been focused on mass production of low-cost electronic devices through a continuous roll-to-roll printing process. The production of electronic devices through a conventional batch method did not exhibit high productivity due to an intermittent way of production and the complexity of a production process attributable to etching or the like.

By contrast, roll-to-roll production using a continuous process enables materials to be continuously produced, and directly prints ink that may include even metal nanoparticles, such as silver or nickel on a material, thus rapidly increasing production speed. Yet, there remains a problem to be solved before applying the same conventional roll-to-roll printing process used for printing a general media to a roll-to-roll printing for electronic devices, that is, the problem of printing precision. The precision of a conventional printing process is about one hundred microns, which is the limit of error that can be detected by human eyes. An electronic device, however, requires a printing precision of, typically, one to fifty microns or less depending on a specific field of application.

A typical printing process using a continuous process uses either a sectional type register controller or a compensator roll type register controller for correcting register errors. In a recent continuous printing process, a sectional type register controller is being more used.

FIGS. 1 and 2 schematically show the two types of controllers typically used in the prior art. FIG. 1 shows the construction of a the compensator roll type register controller 10, in which the compensator roll type register controller transfers a driving force using a single main motor 12 and a shaft 14, thus rotating respective printing cylinders 20. At each roller, a gearbox 16 is installed and all printing cylinders 20 are rotating with the same speed. Register errors, the errors in printing positions, are measured by sensors 27 shown in FIG. 2 at suitable positions 25 in respective spans, the intervals between adjacent printing cylinders, and controlled and compensated for by changing span lengths, or equivalently, by changing phase differences between printing cylinders, through the motion of the compensator rolls 30 installed between respective printing cylinders 20. This scheme, however, has a relatively low efficiency in the aspect of cost and spatial utility because it requires additional equipments, such as compensator rolls, main motors, gearboxes, and linear motion guides, to be installed.

Such disadvantages are overcome in a printing scheme using a sectional type register controller 10 shown in FIG. 2. In this scheme, the respective printing cylinders 20 are driven by individual drivers 24 and motors 25 to allow speed control of individual priming cylinders 20, so a main shaft and compensator rolls are not needed. The way of controlling register errors is also different from a conventional compensator roll type printer. In a printer system employing a sectional type controller, register errors are measured at predetermined positions 25 by register sensors 27 positioned behind printing cylinders 20, and relayed to the sectional register controller 10, which then generates register control signals 30 to compensate for the register errors. The register control signals 30 are transferred then to a main controller 28 that controls the velocity and phase of each printing cylinder 20, which then distributes individual signals 32 to the individual drivers 24 to change the speeds of individual printing cylinders 20 through the motors 25. In this scheme, the changes in the speeds or phases of printing cylinders are in proportion to the magnitudes of register errors.

There is another important, probably the most important, difference between the two printing schemes. In the conventional compensator roll type printer, the motion of compensator rolls, designed to compensate for a register error of a particular span, influences not only the length of that particular span, but the length of subsequent spans. In the sectional type printer, however, the speed variation inputted into a particular printing cylinder for the purpose of compensating for a register error associated with that particular printing cylinder, influences not only the phase of that particular printing cylinder, but also the phases of subsequent printing cylinders. Therefore, in this type of a printing system, even when a register error in the current span is compensated for by changing the speed of the printing cylinder associated therewith, another register error occurs in subsequent spans due to the very action of compensation performed for correcting the error in the current span, that is, changing the speed of the printing cylinder associated with the current span.

This kind of phenomenon for the sectional type printer is illustrated in FIG. 3 showing register errors Y2 and Y3 and variations in tension T2 and T3 generating, respectively, in the first span between first and second printing cylinders 1 and 2, and in the second span between second and third printing cylinders 2 and 3 when the speed of the second printing cylinder 2 is changed using a square-type pulse input, V2. It can be seen that a register error occurs in the first span as well as in the second span, and the two register errors have the same magnitude, but opposite directions.

In a typical printing system, register errors caused in respective spans are controlled by using only a feedback control method using, for example, a proportional-integral-derivative (PID) control algorithm in each printing cylinder. However, in a roll-to-roll printing process of electronic devices that requires ultra-precision register control, the use of a conventional feedback control method alone is not enough for realizing such a desired level of precision due to the register errors that will occur in subsequent spans, being caused by the compensations performed in previous spans to upstream printing cylinders.

Therefore, there is a need in the art of a roll-to-roll printing process of electronic devices to develop a register compensation control method that is capable of compensating for, in advance, the register errors occurring in subsequent spans due to the speed inputs into upstream printing cylinders in previous spans, which are inputted to compensate for register errors occurring in the previous spans.

SUMMARY OF THE INVENTION

Recognizing the aforementioned problem in the art, an object of the present invention is to provide an ultra-precision register control method in a continuous roll-to-roll printing process for manufacturing electronic devices, which compensates for additional register errors attributable to variations in the speed of upstream printing cylinders by using feedforward control logic, thus preventing such additional register errors from occurring.

Another object of the present invention is to provide a feedforward control logic in which the speed variations of downstream printing cylinders can be calculated to compensate for additional register errors arising from the speed changes of upstream printing cylinders.

Still another object of the present invention is to enable the implementation of a roll-to-roll printing system for producing suitable electronic devices, by providing a register control method that achieves ultra-high precision of printing.

In order to accomplish the objects stated above, an ultra-precision register control method is devised in the present invention for a system of a continuous roll-to-roll printing process for manufacturing electronic devices. The system has N printing cylinders, where N is an integer equal to or greater than 3, and a material continuously fed to the printing cylinders for printing the electronic devices thereon.

In accordance with the above objects, the present invention provides an ultra-precision register control method in a continuous roll-to-roll printing system having N (3 or more) printing cylinders for manufacturing electronic devices. In an aspect of the invention the method may include: measuring a first register error for the material, having passed through a second printing cylinder; calculating a first feedback speed variation of the second printing cylinder to compensate for the first register error; changing the speed of the second printing cylinder by the first feedback speed variation of the second printing cylinder; measuring a second register error for the material, having passed through a third printing cylinder; calculating a second feedback speed variation of the third printing cylinder to compensate for the second register error; calculating a first feedforward speed variation of the third printing cylinder by using as an input the changed speed of the second printing cylinder; and changing the speed of the third printing cylinder by addition of the second feedback speed variation of the third printing cylinder and the first feedforward speed variation of the third printing cylinder.

In an aspect of the invention, the calculation of the first feedforward speed variation of the third printing cylinder, $V_3$, under a feedforward control logic may be calculated by the following equation:

$$V_3(s) = \left[1 - \frac{1}{\tau s + 1} + e^{-\tau s}\right] V_2(s)$$

where $V_2$ is the variation in speed of the second printing cylinder, $\tau$ is a time constant and s is a Laplace domain variable (complex variable).

Also, changing the speed of the second printing cylinder may include generating a first feedback control compensation signal from the first feedback speed variation of the second printing cylinder; and inputting the first feedback control compensation signal into a driver that controls the speed of the second printing cylinder. Further, changing the speed of the third printing cylinder may include generating a second feedback control compensation signal from the second feedback speed variation of the third printing cylinder; generating a first feedforward control compensation signal from the first feedforward speed variation of the third printing cylinder; and inputting a register control signal, obtained by adding the second feedback control compensation signal to the first feedforward control compensation signal, into a driver that controls the speed of the third printing cylinder.

In one aspect of the invention, the ultra-precision register control method in the present method may further include controlling tension of the material fed to a first printing cylinder while the material passes through an unwinder section and an infeed section to prevent extra register errors occurring from failure to control the tension of the material fed to a first printing cylinder.

Moreover, the ultra-precision register control method in the present method may further include steps of applying the same type of a feedforward logic, which has been applied to the third printing cylinder, to all subsequent printing cylinders such that, for $(i)_{th}$ printing cylinder (i=4, 5, 6, . . . N), the method may further include the steps of: measuring an $(i-1)_{th}$ register error for the material, having passed through an $(i)_{th}$ printing cylinder; calculating an $(i-1)_{th}$ feedback speed variation of the $(i)_{th}$ printing cylinder to compensate for the $(i-1)_{th}$ register error; calculating an $(-2)_{th}$ feedforward speed variation of the $(i)_{th}$ printing cylinder by using as an input the changed speed of the $(i-1)_{th}$ printing cylinder; changing the speed of the $(i)_{th}$ printing cylinder by addition of the $(i-1)_{th}$ feedback speed variation of the $(i)_{th}$ printing cylinder and the $(i-2)_{th}$ feedforward speed variation of the $(i)_{th}$ printing cylinder.

Also, the changing the speed of the $(i)_h$ printing cylinder may include generating an $(i-1)_{th}$ feedback control compensation signal from the $(i-1)_{th}$ feedback speed variation of the $(i)_{th}$ printing cylinder; generating an $(i-2)_{th}$ feedforward control compensation signal from the $(i-2)_{th}$ feedforward speed variation of the $(i)_{th}$ printing cylinder; and inputting a register control signal, obtained by adding the $(i-1)_{th}$ feedback control compensation signal to the $(i-2)_{th}$ feedforward control compensation signal, into a driver that controls the speed of the $(i)_{th}$ printing cylinder.

Further, the calculation of the $(i-2)_{th}$ feedforward speed variation of the $(i)_{th}$ printing cylinder, $V_i$, (i=4, . . . N), may be calculated by the following equation, $$V_i(s) = \left[1 - \frac{1}{\tau s + 1} + e^{-\tau s}\right] V_{i-1}(s)$$

In another aspect, the present invention also provides a method of compensating for register errors that are attributable to variations in the speed of an upstream printing cylinders in a system of a continuous roll-to-roll printing process, having N (three or more) printing cylinders for manufacturing electronic devices. The method may include: calculating a speed variation of an $(i)_{th}$ printing cylinder, $V_i$, (i=3, 4, . . . N), by using as an input a changed speed of an $(i-1)_{th}$ printing cylinder, $V_{i-1}$, via the following equation, $$V_i(s) = \left[1 - \frac{1}{\tau s + 1} + e^{-\tau s}\right] V_{i-1}(s),$$

where $\tau$ is a time constant and s is a Laplace domain variable (complex variable); and changing the speed of the $(i)_{th}$ printing cylinder by a quantity that includes the calculated speed variation of the $(i)_{th}$ printing cylinder, and thereby to compensate for an additional register error that is attributable to the changed speed of an $(i-1)_{th}$ printing cylinder. Here, '$\tau$' is calculated by an equation of L/V. Here, L designates a length of a span between adjacent cylinders and V designates an operating speed of the system of a continuous roll-to-roll printing process.

One of the advantages provided by the ultra-precision register control method according to the present invention is the capability of afore compensating for the register errors attributable to variations in the speed of upstream printing cylinders, and thus eliminating in advance the occurrence of such register errors to realize ultra-precision printing of electronic devices in a roll-to-roll printing system.

Another advantage provided by the present invention is the capability of implementing a roll-to-roll printing system for printing the electronic devices that require ultra-high printing precision and thus were formerly unsuitable for roll-to-roll printing, by providing a register control method that achieves such a ultra-high precision of printing.

DETAILED DESCRIPTION OF THE PREFERRED EMBODIMENT

The drawings to be described herein are shown for purposes of illustrating only certain embodiments of the present invention, and not for any purpose of limiting the invention.

Figure 4:
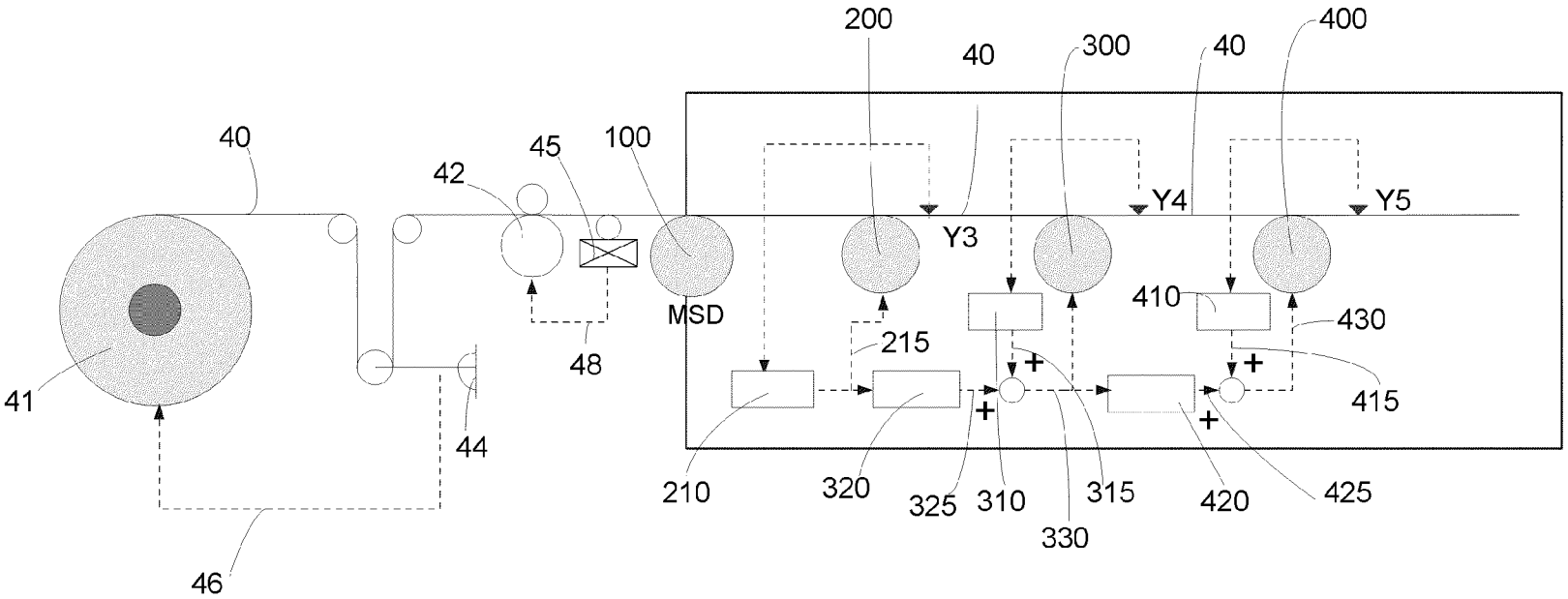
FIG. 4 is a schematic diagram showing steps of an ultra-precision register control method in accordance of the present invention in a roll-to-roll process for manufacturing electronic devices.
Figure 5:
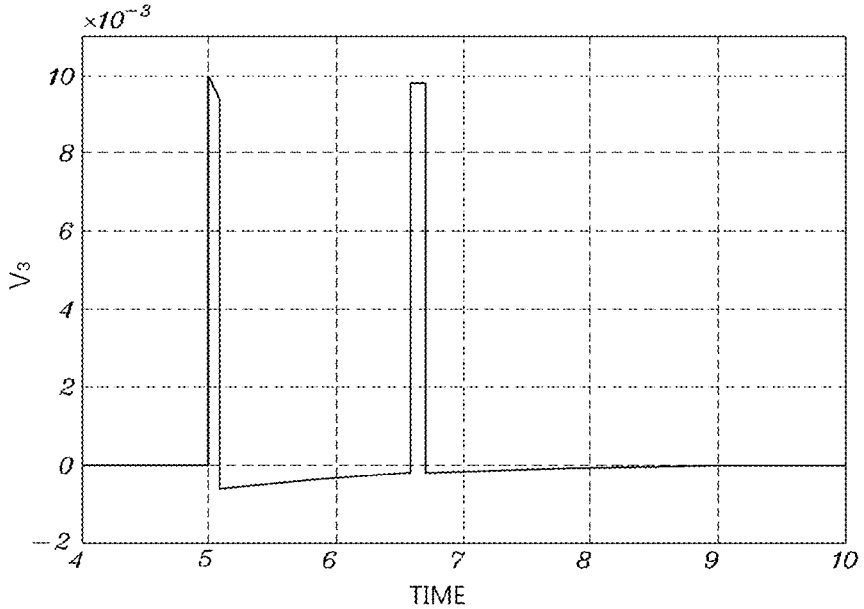
FIG. 5 shows the speed input $V_3$ to the third printing cylinder, calculated from a pulse-typed speed input to the second printing cylinder in FIG. 3 according to the feedforward register control logic in the present invention.
Figure 6:
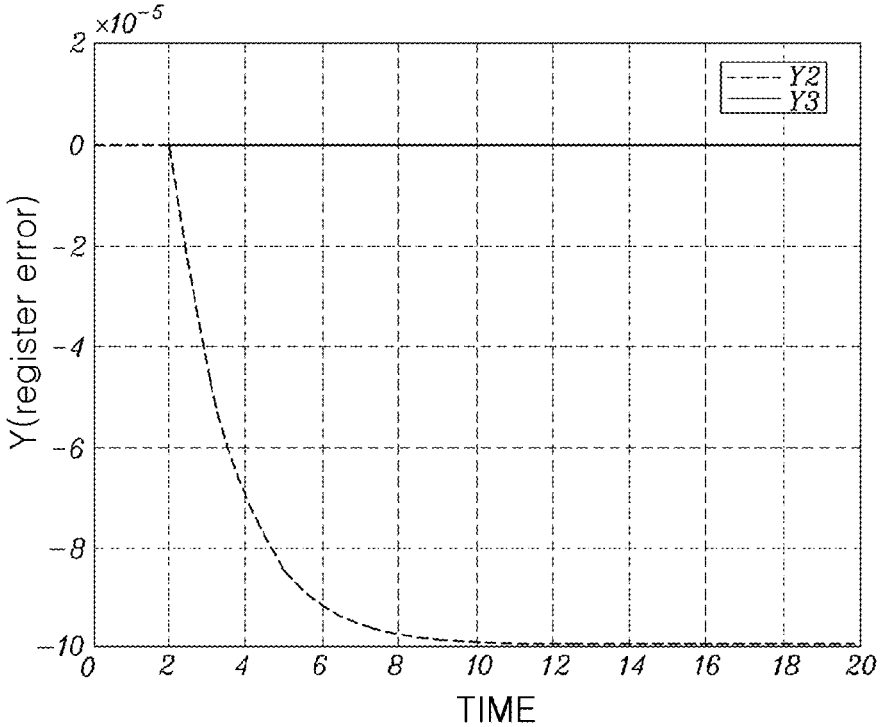
FIG. 6 is shows register errors $Y_2$ and $Y_3$ when the speed of the third printing cylinder is changed by the speed input $V_3$ in the FIG. 5.

Now referring to FIGS. 4-6, FIG. 4, schematically shows a roll-to-roll printing system having four printing cylinders and employing sectional type register controllers. Such a printing system of four printing cylinders in FIG. 4 has been presented only for simplicity for an illustration purpose. The roll-to-roll printing system contemplated by the present invention for application of the ultra-precision register control method in manufacturing electronic devices via a roll-to-roll process includes any number of printing cylinders equal to or greater than three.

In FIG. 4, a material 40 to print electronic devices thereon is inputted to a first printing cylinder 100 via an unwinder roll 41 and an infeed roll 42. Next, for the material having passed through the first printing cylinder 100 and second printing cylinder 200, a first register error $Y_3$ is measured by a register sensor (as the one 27 shown in FIG. 2) installed behind the second printing cylinder 200, in the third span. The first register error $Y_3$ has been generated by the second printing cylinder 200 and carried on the material 40 between the second and third printing cylinders, 200 and 300, the third span. The register sensor could be a vision system, an optical sensor, a laser displacement measurement sensor, or any other device that is designed to read a register error and convert the error into an electric signal to transfer to a register controller electrically connected thereto. The structure and function of such register sensors are well known in the art, and thus not described herein further.

Figure 1:
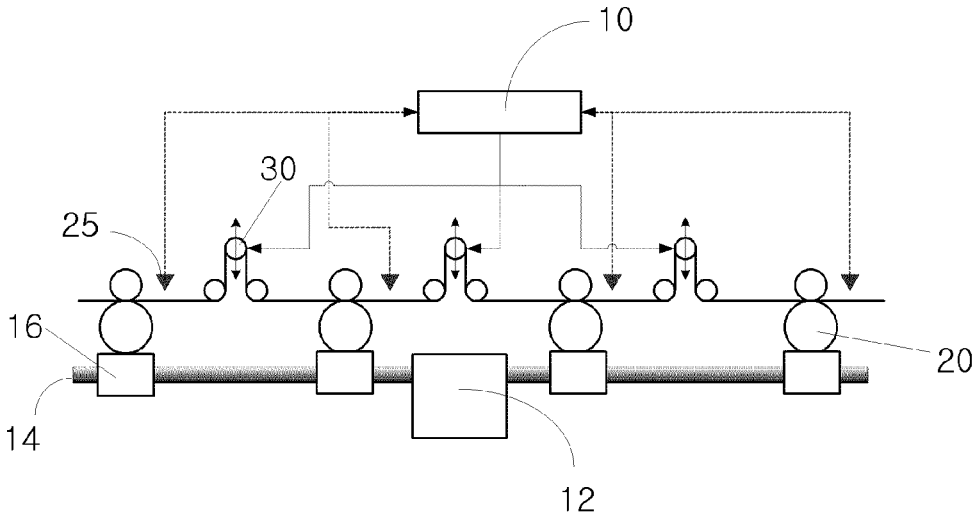
FIG. 1 is a schematic diagram showing the construction of a compensator roll type register controller.
Figure 2:
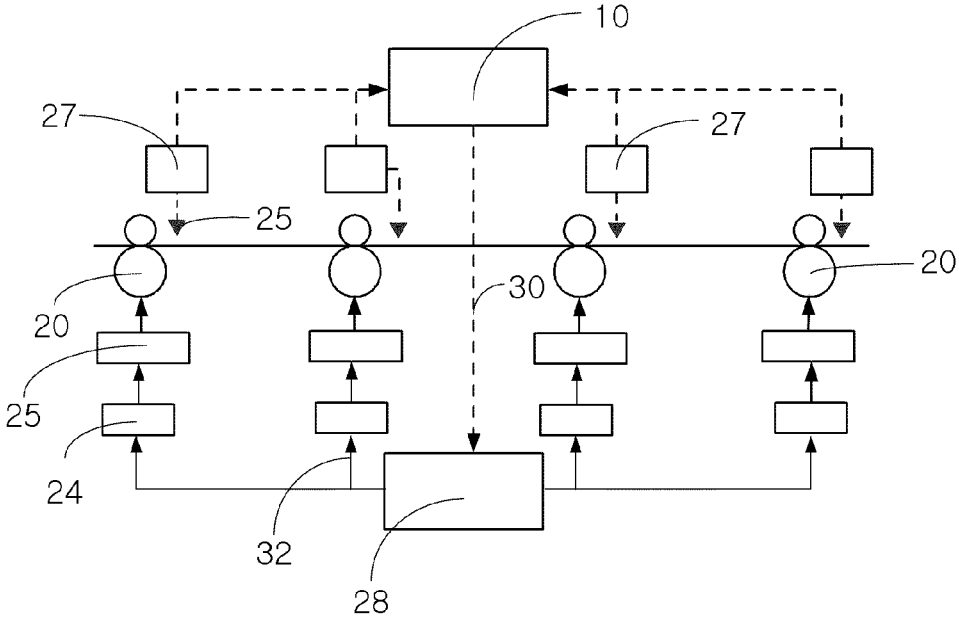
FIG. 2 is a schematic diagram showing the construction of a sectional type register controller.

After receiving an electric signal from the register sensor (not shown) for the register error $Y_3$ in the third span, a feedback controller 210 calculates, following a conventional feedback control logic, a first feedback speed variation of the second printing cylinder 200 that would compensate for, and thus eliminate, the first register error $Y_3$ caused by the second printing cylinder 200. Then the feedback controller 210 then generates a first feedback control compensation signal 215. Thereafter, the first feedback control compensation signal 215 is inputted to a driver or a motor (not shown) that is connected to the second printing cylinder 200 to have its speed changed by the calculated value of the first feedback speed variation of the second printing cylinder 200. FIG. 2 shows such drives 24 or motors 25 in a sectional type register controller. The calculation, performed by a feedback controller, of a variation in the speed of a particular printing cylinder for a given value of a register error measured on the material after that printing cylinder under a conventional feedback control logic is well known in the art, and thus, not described herein further.

In order to compensate for the register errors in the subsequent spans, the same kind of steps following the feedback control logic are repeated. For the material having passed through the third printing cylinders 300, a second register error $Y_4$, which occurs in the fourth span, is measured by a register sensor installed behind the third printing cylinder 300, and relayed to a feedback controller 310. The feedback controller 310 may be the feedback controller 210 itself in one embodiment, or a separate one but of the same kind in another embodiment. The feedback controller 310 calculates a second feedback speed variation of the third printing cylinder 300 that would compensate for the register error $Y_4$, and generates a second feedback control compensation signal 315 for effecting the speed change of the third printing cylinder 300 by the calculated value of the speed variation.

However, as previously discussed, an additional register error is expected to occur in the fourth span due to the variation of the speed of the second printing cylinder 200, which has been inputted to the second printing cylinder 200 for compensating for the register error $Y_3$. Due to such an additional register error anticipated in the fourth span, merely compensating for the register error in the fourth span by a conventional feedback control logic outlined above will not be sufficient for compensating for the register errors and realizing the ultra-high printing precision needed in the roll-to-roll printing of electronic devices.

To compensate for such an additional register error, and thereby, to realize the ultra-high printing precision in a roll-to-roll printing process, the present invention devises and provides a feedforward control logic that is designed to compensate, in advance, for such an anticipated additional register error. When used together with the conventional feedback control logic, the feedforward control logic in the present invention will be able to greatly reduce the register errors.

FIG. 4 also shows the feedforward control logic embedded in the method in the present invention, where the feedforward control logic is employed together with the conventional feedback control logic. While the feedback controller 310 generates the second feedback control compensation signal 315, a feedforward controller 320 calculates, by using as an input the first feedback control compensation signal 215 reflecting the first feedback speed variation of the second printing cylinder 200, a first feedforward speed variation of the third printing cylinder 300 that would compensate for the additional register error attributable to the variation of the second printing cylinder 200. The feedforward controller 320 then generates a first feedforward compensation control signal 325 for effecting the speed change of the third printing cylinder 300 by the calculated value of the first feedforward speed variation. Then, a register control signal 330 obtained by adding the first feedforward control compensation signal 325 and the second feedback control compensation signal 315, is inputted into a driver (not shown) connected to the third printing cylinder 300. By the register control signal 330, the speed of the third printing cylinder 300 is changed by a net speed variation, which is equal to the addition of the calculated second feedback speed variation and the calculated first feedforward speed variation of the third printing cylinder. Such change of the speed of the third printing cylinder would compensate for, not only the register error $Y_4$, but also the additional register error, which is attributable to the speed variation that occurred in the upstream printing cylinder 200 and expected to occur.

FIG. 4 further shows a similar kind of steps of feedback and feedforward control logics being repeated for the third and fourth printing cylinders 300 and 400. A third register error YS is measured for the material, having passed through a fourth printing cylinder 400. And therefrom, a feedback controller 410 calculates a third feedback speed variation of the fourth printing cylinder 400 and generates a third feedback control compensation signal 415 corresponding to the calculated third feedback speed variation. Then, a feedforward controller 420 calculates a second feedforward speed variation of the fourth printing cylinder 400 by using as an input the net speed variation 330 of the third printing cylinder 300, and generates a second feedforward compensation control signal 425 corresponding to the second feedforward speed variation of the fourth printing cylinder 400. Lastly, a register control signal 430, obtained by adding the third feedback control compensation signal 415 to the second feedforward compensation control signal 425, to the forth printing cylinder 400 to cause the speed of the fourth printing cylinder 400 to be changed by the net speed variation, which is equal to the addition of the calculated third feedback speed variation and the calculated second feedforward speed variation of the fourth printing cylinder 400.

In the present invention, the application of the feedforward control logic described above need not be limited up to four printing cylinders as schematically illustrated in FIG. 4, but may be extended to all subsequent printing cylinders in the roll-to-roll system, by which all register errors occurring at downstream printing cylinders, and attributable to the speed variations of upstream printing cylinders, may be compensated for.

The ultra-precision register control method utilizing the feedforward logic in the present invention can be practiced for a system of a continuous roll-to-roll printing process for manufacturing electronic devices, which has at least three or more printing cylinders. In accordance with the present invention, the similar steps of feedback and feedforward control logics of the ultra-precision register control method illustrated in FIG. 4 can be performed for any two consecutive printing cylinders, an $(i)_{th}$ printing cylinder and a subsequent $(i-1)_{th}$ printing cylinder, (i=3, 4, . . . ), included in the roll-to-roll system of N (three or more) printing cylinders.

An $(i-1)_{th}$ register error is measured for the material having passed through the $(i)_{th}$ printing cylinder by a register sensor installed behind the $(i)_{th}$ printing cylinder. Then, a feedback controller calculates, from the measured $(i-1)_{th}$ register error, a value of an $(i-1)_{th}$ feedback speed variation of the $(i)_{th}$ printing cylinder that would compensate for the measured $(i-1)_{th}$ register error, and generates an $(i-1)_{th}$ feedback control compensation signal corresponding to the calculated $(i-1)_{th}$ feedback speed variation to effect the change of the speed of the $(i)_{th}$ printing cylinder. At the same time, a feedforward controller calculates, from using as an input the net speed variation of the $(i-1)_{th}$ printing cylinder, an $(i-2)_{th}$ feedforward speed variation of the $(i)_{th}$ printing cylinder, which would compensate for an additional register error attributable to the net speed variation of the $(i-1)_{th}$ printing cylinder, and generates an $(i-2)_{th}$ feedforward compensation control signal corresponding to the calculated $(i-2)_{th}$ feedforward speed variation. Finally, a register control signal, obtained by adding the $(i-1)_{th}$ feedback control compensation signal to the $(i-2)_{th}$ feedforward compensation control signal, is inputted into a driver connected to the $(i)_{th}$ printing cylinder to cause the speed of the $(i)_{th}$ printing cylinder to be changed by a net speed variation equal to the addition of the calculated $(i-1)_{th}$ feedback speed variation and the calculated $(i-2)_{th}$ feedforward speed variation of the $(i)_{th}$ printing cylinder.

In the present invention, the speed variation of the $(i)_{th}$ printing cylinder calculated according to the feedforward control logic is derived as a function of the speed variation of the $(i-1)_{th}$ printing cylinder by using a tension model and a register error model. Actual calculation of the speed variation of the $(i)_{th}$ printing cylinder via the derived equation, with the value of speed variation of the $(i-1)_{th}$ printing cylinder as an input, is performed by the feedforward controller(s).

Figure 3:
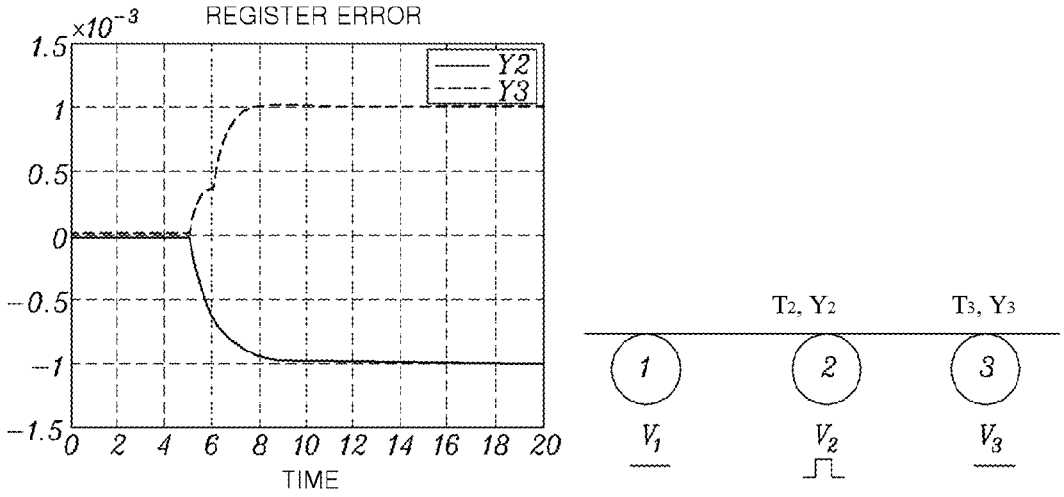
FIG. 3 illustrates a graph and construction showing register errors between first and second printing cylinders and between second and third printing cylinders when the speed of the second printing cylinder is changed using a pulse.

To derive the equation to calculate the value of the speed variation of a printing cylinder that would compensate for the register error attributable to the speed variation of an upstream printing cylinder, a tension model and a register error model are used. To describe such derivation, a model roll-to-roll printing system having three printing cylinders, as schematically shown in FIG. 3, is considered for simplicity.

1. Tension Model

The following equations represent the tension model of a system having two spans, first and second, as shown in FIG. 5, $$\frac{d}{dt}[T_2(t)] = -\frac{v_{20}}{L}T_2(t) + \frac{v_{10}}{L}T_1(t) + \frac{AE}{L}(V_2(t) - V_1(t)) \quad (1)$$

$$\frac{d}{dt}[T_3(t)] = -\frac{v_{30}}{L}T_3(t) + \frac{v_{20}}{L}T_2(t) + \frac{AE}{L}(V_3(t) - V_2(t)) \quad (2)$$

where $T_i$ (i=1, 2) is the variation in tension of the material in the $(i)_{th}$ span, $v_{io}$ is the initial speed of $(i)_{th}$ printing cylinder, L is the length of one span, $V_i$ is the variation in speed of $(i)_{th}$ printing cylinder, A is the area of the material in each span, and E is the modulus of direct elasticity of the material.

2. Register Error Model

The register model of a system having two spans, as shown in FIG. 3 is given by the following Equations (3) and (4), $$Y_2 = \frac{\overline{v}}{s}(-H_2 + H_1 e^{-\tau s}) \quad (3)$$

$$Y_3 = \frac{\overline{v}}{s}(-H_3 + H_2 e^{-\tau s}) \quad (4)$$

where, $\tau$ is a time constant, $H_i$ (i=1, 2) is the variation in strain of the material in the $(i)_{th}$ span, $Y_1$ is the variation in register error in the $(i)_{th}$ span, and v is the operation speed, and S is the Laplace domain variable (complex variable). Further, the variation in tension $T_i$ and the variation in strain $H_i$ in the $(i)_{th}$ span are related by the following equation, $$T_i = AEH_i \quad (5)$$

Using the equations above, the value of variation in the speed of the third printing cylinder $V_3$, required to compensate for the register error $Y_3$ is found as, $$V_3(s) = \left[1 - \frac{1}{\tau s + 1} + e^{-\tau s}\right] V_2(s) \quad (6)$$

where $V_2$ is variation in the speed of the second printing cylinder. This value of variation in the speed of the third printing cylinder $V_3$ in the Equation (6) is the value, when implemented to the speed of the third printing cylinder $V_3$, to make the register error $Y_3$ in the Equation (4) mathematically zero.

The Equations (3)-(5) apply, not only to the second and third printing cylinders in a model roll-to-roll printing system of FIG. 5, but applies generally to any two consecutive printing cylinders, $(i)_{th}$ and $(i-1)_{th}$ printing cylinders having respectively the speed variations $V_i$ and $V_{i-1}$, of a roll-to-roll printing system having at least three or more printing cylinders. Therefore, the speed variations $V_i$ and $V_{i-1}$ satisfy exactly the same form of the equation as Equation (6) such that $$V_i(s) = \left[1 - \frac{1}{\tau s + 1} + e^{-\tau s}\right] V_{i-1}(s) \quad (7)$$

$$(i = 3, 4 \ldots).$$

FIGS. 5 and 6 illustrate how a register error is compensated for when a speed variation calculated following the Equation (6) is inputted into a printing cylinder in a model roll-to-roll printing system shown in FIG. 3.

As aforementioned in describing FIG. 3, when a pulse-type speed variation $V_2$ is given to the second printing cylinder, it produces register errors $Y_2$ and $Y_3$. To compensate for the register error $Y_3$, which is attributable to the speed variation $V_2$ of an upstream printing cylinder, the second cylinder, a speed variation $V_3$ of the third printing cylinder is calculated from pulse-type speed variation $V_2$ the according to the Equation (6) under the feedforward control logic in the present invention. FIG. 5 shows the calculated speed variation $V_3$ to be applied to the third printing cylinder. This kind of calculation is performed in the feedforward controllers 220, 320 or 420 in FIG. 4, which then generate feedforward compensation control signals for actually implementing the calculated speed changes in the corresponding printing cylinders. FIG. 6 shows how the register error $Y_3$ shown in FIG. 3, arising from the speed variation of an upstream printing cylinder, the second printing cylinder, becomes completely compensated for and vanishes when the calculated speed variation $V_3$ shown in FIG. 5 is actually implemented to the third printing cylinder.

When the speeds of downstream printing cylinders are controlled through this method of the present invention using the feedforward control logic, the undesired additional register errors, attributable to the speed variations in the upstream printing cylinders effected thereon for compensation purpose, would be compensated for, as can be seen in FIG. 6.

In a roll-to-roll printing system having a plurality of printing cylinders, the tension of a material inputted to a first printing cylinder, if not controlled to be steady, may cause additional undesirable register errors occurring in the subsequent printing cylinders. Therefore, the tension of a material inputted to a first printing cylinder needs to be controlled. This can be done through an unwinder section 46 and an infeed section 48 via individual tension controllers 44 and 45 shown in FIG. 4, which are connected to the unwinder roll 41 and the infeed roll 42 for controlling tension. The structures and functions of the unwinder roll, infeed roll, and the tension controllers are well known in the art of a roll-to-roll printing system and thus not described herein further.

Through the afore-described method of feedforward control logic, the additional register errors attributable to variations in the speed of upstream printing cylinders can be compensated for and eliminated. As compared to the method of compensating for register errors in the conventional technology of the art, which uses only the typical feedback control logic, the register control method in the present invention that combines the feedforward control logic and the feedback control logic realizes much more precise register control of a printing system, and thus, enables the implementation of a roll-to-roll printing process for printing electronic devices formerly unavailable.

While particular forms of the inventions have been illustrated and described, it will be apparent to those skilled in the art that various modifications, additions and substitutions can be made without departing from the inventive concept. References to use of the invention with a specific materials, parts, or procedures in describing and illustrating the invention herein are by way of example only, and the described embodiments are to be considered in all respects only as illustrative and not restrictive. The present invention may be embodied in other specific forms without departing from its spirit or essential characteristics. Accordingly, it should be understood that the scope of the invention is defined by the accompanying claims only.

We claim:

1. A method of controlling register errors with ultra-precision in a system of a continuous roll-to-roll printing process for manufacturing electronic devices, the system having N printing cylinders having numerical orders of 1, 2, . . . , i, . . . N, respectively, where N is an integer equal to or greater than 3, and a material continuously fed to the printing cylinders for printing the electronic devices thereon, the method comprising the steps of:

(a) measuring a first register error for the material, after the material having passed through a second printing cylinder;

(b) calculating a first feedback speed variation of the second printing cylinder to compensate for the first register error;

(c) changing the speed of the second printing cylinder by the first feedback speed variation of the second printing cylinder;

(d) measuring a second register error for the material, after the material having passed through a third printing cylinder;

(e) calculating a second feedback speed variation of the third printing cylinder to compensate for the second register error;

(f) calculating a first feedforward speed variation of the third printing cylinder by using as an input the first feedback speed variation of the second printing cylinder; and (g) changing the speed of the third printing cylinder by a net speed variation of the third printing cylinder equal to the addition of the second feedback speed variation of the third printing cylinder and the first feedforward speed variation of the third printing cylinder, wherein in step (f) the first feedforward speed variation of the third printing cylinder, $V_3$, is represented by the following equation, $$V_3(s) = \left[1 - \frac{1}{\tau s + 1} + e^{-\tau s}\right] V_2(s)$$

$$\begin{aligned} L^{-1}[V_3(s)] &= L^{-1}\left[V_2(s) - \frac{1}{\tau s + 1} V_2(s) + V_2(s)e^{-\tau s}\right] \\ &= L^{-1}[V_2(s)] - L^{-1}\left[\frac{1}{\tau}\frac{1}{\left(s + \frac{1}{\tau}\right)} V_2(s)\right] + L^{-1}[V_2(s)e^{-\tau s}] \\ &= \upsilon_2(t) - \frac{1}{\tau} e^{\left(-\frac{1}{\tau}\right)t} \upsilon_2(t) + \upsilon_2(t - \tau) \end{aligned}$$

where $V_2$ is the first feedback speed variation of the second printing cylinder, $\tau$ is a time constant, and s is a Laplace domain variable (complex variable), and wherein $\tau$ is calculated by an equation of L/V, L designating a length of a span between adjacent cylinders and V and $\nu$ designating an operating speed of the system of a continuous roll-to-roll printing process in Laplace domain and in time domain, respectively.

2. The method of claim 1, wherein changing the speed of the second printing cylinder includes:

generating a first feedback control compensation signal from the first feedback speed variation of the second printing cylinder; and inputting the first feedback control compensation signal into a driver that controls the speed of the second printing cylinder.

3. The method of claim 1, wherein changing the speed of the third printing cylinder includes:

generating a second feedback control compensation signal from the second feedback speed variation of the third printing cylinder;

generating a first feedforward control compensation signal from the first feedforward speed variation of the third printing cylinder; and inputting a register control signal, obtained by adding the second feedback control compensation signal to the first feedforward control compensation signal, into a driver that controls the speed of the third printing cylinder.

4. The method of claim 1, further comprising controlling tension of the material fed to a first printing cylinder while the material passes through an unwinder section and an infeed section.

5. The method of claim 1, if the numerical order of the printing cylinder in step (g) is less than N, further comprising the steps of:

(h) measuring an $(i-1)_{th}$ register error for the material, after the material having passed through an $(i)_{th}$ printing cylinder;

(i) calculating an $(i-1)_{th}$ feedback speed variation of the $(i)_{th}$ printing cylinder to compensate for the $(i-1)_{th}$ register error;

(j) calculating an $(i-2)_{th}$ feedforward speed variation of the $(i)_{th}$ printing cylinder by using as an input the net speed variation of the $(i-1)_{th}$ printing cylinder;

(k) changing the speed of the $(i)_{th}$ printing cylinder by a net speed variation of the $(i)_{th}$ a printing cylinder equal to the addition of the $(i-1)_{th}$ feedback speed variation of the $(i)_{th}$ printing cylinder and the $(i-2)_{th}$ feedforward speed variation of the $(i)_{th}$ printing cylinder; and (l) repeating steps (h)-(k) if the numerical order of the printing cylinder whose speed is changed in step (k) is less than N.

6. The method of claim 5, wherein changing the speed of the $(i)_{th}$ printing cylinder includes:

generating an $(i-1)_{th}$ feedback control compensation signal from the $(i-1)_{th}$ feedback speed variation of the $(i)_{th}$ printing cylinder;

generating an $(i-2)_{th}$ feedforward control compensation signal from the $(i-2)_{th}$ feedforward speed variation of the $(i)_{th}$ printing cylinder; and inputting a register control signal, obtained by adding the $(i-1)_{th}$ feedback control compensation signal to the $(i-2)_{th}$ feedforward control compensation signal, into a driver that controls the speed of the $(i)_{th}$ printing cylinder.

7. The method of claim 5, wherein in each repeated step (j), the $(i-2)_{th}$ feedforward speed variation of the $(i)_{th}$ a printing cylinder, $V_i$, (i=4, . . . N), is calculated by the following equation, $$V_i(s) = \left[1 - \frac{1}{\tau s + 1} + e^{-\tau s}\right] V_{(i-1)}(s)$$

$$\begin{aligned} L^{-1}[V_i(s)] &= L^{-1}\left[V_{i-1}(s) - \frac{1}{\tau s + 1} V_{i-1}(s) + V_{i-1}(s)e^{-\tau s}\right] \\ &= L^{-1}[V_{i-1}(s)] - L^{-1}\left[\frac{1}{\tau}\frac{1}{\left(s + \frac{1}{\tau}\right)} V_{i-1}(s)\right] + L^{-1}[V_{i-1}(s)e^{-\tau s}] \\ &= \upsilon_{i-1}(t) - \frac{1}{\tau} e^{\left(-\frac{1}{\tau}\right)t} \upsilon_{i-1}(t) + \upsilon_{i-1}(t - \tau) \end{aligned}$$

where $V_{i-1}$ is the net speed variation of the $(i-1)_{th}$ printing cylinder, $\tau$ is a time constant and s is a Laplace domain variable (complex variable).

* * * * *